US012421645B2

(12) United States Patent
Hoppe et al.

(10) Patent No.: US 12,421,645 B2
(45) Date of Patent: Sep. 23, 2025

(54) LAUNDRY WASHING MACHINE WITH ADJUSTABLE WASH CAPACITY

(71) Applicant: Midea Group Co., Ltd., Foshan (CN)

(72) Inventors: Christopher G. Hoppe, Louisville, KY (US); Phillip C. Hombroek, Prospect, KY (US); Bryan T. Snook, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 239 days.

(21) Appl. No.: 18/193,016

(22) Filed: Mar. 30, 2023

(65) Prior Publication Data

US 2023/0235497 A1 Jul. 27, 2023

Related U.S. Application Data

(62) Division of application No. 15/457,398, filed on Mar. 13, 2017, now Pat. No. 11,629,448.

(51) Int. Cl.

| | |
|---|---|
| ***D06F 37/26*** | (2006.01) |
| ***D06F 17/10*** | (2006.01) |
| ***D06F 37/08*** | (2006.01) |

(52) U.S. Cl.
CPC ..... *D06F 37/263* (2013.01); *D06F 37/08* (2013.01); *D06F 17/10* (2013.01)

(58) Field of Classification Search
CPC ..... D06F 37/06; D06F 37/08; D06F 37/263; D06F 37/02–18
See application file for complete search history.

(56) References Cited

U.S. PATENT DOCUMENTS

| | | | | |
|---|---|---|---|---|
| 2,530,822 | A | 11/1950 | Kahn | |
| 2,648,211 | A | 8/1953 | Eberlein | |
| 2,937,516 | A | 5/1960 | Hugo | |
| 3,938,260 | A | 2/1976 | Brenner et al. | |
| 5,727,402 | A * | 3/1998 | Wada | D06F 35/006 68/23.5 |
| 5,746,070 | A | 5/1998 | Bailey et al. | |
| 6,510,715 | B1 | 1/2003 | Simsek | |
| 6,971,189 | B1 | 12/2005 | Anibas | |
| 7,942,025 | B1 | 5/2011 | Musone | |
| 2001/0017301 | A1 * | 8/2001 | Klemm | D06F 37/262 220/660 |
| 2004/0148981 | A1 | 8/2004 | Kim et al. | |
| 2005/0132556 | A1 | 6/2005 | Bobed | |

(Continued)

FOREIGN PATENT DOCUMENTS

| | | |
|---|---|---|
| CN | 2308617 Y | 2/1999 |
| CN | 2434325 Y | 6/2001 |

(Continued)

OTHER PUBLICATIONS

International Search Report and Written Opinion issued in Application No. PCT/CN2017/102130 dated Dec. 27, 2017.

*Primary Examiner* — Spencer E. Bell
(74) *Attorney, Agent, or Firm* — Gray Ice Higdon

(57) ABSTRACT

A wash drum apparatus and method of adjusting the wash capacity for a laundry washing machine. The wash drum may include one or more rear cover inserts that may adjust the wash capacity of the wash drum. The rear cover insert may include one or more impellers. The wash drum may include a rear cover.

20 Claims, 5 Drawing Sheets

(56) References Cited

U.S. PATENT DOCUMENTS

| | | | |
|---|---|---|---|
| 2006/0005585 | A1 | 1/2006 | Lee et al. |
| 2006/0162395 | A1 | 7/2006 | La Belle et al. |
| 2009/0308109 | A1 | 12/2009 | Geyer et al. |
| 2010/0272935 | A1 | 10/2010 | Muller et al. |
| 2014/0096571 | A1 | 4/2014 | Jang et al. |
| 2015/0337479 | A1 | 11/2015 | Senn et al. |
| 2018/0038034 | A1 | 2/2018 | Kwak et al. |
| 2019/0257020 | A1 | 8/2019 | Ikeda et al. |

FOREIGN PATENT DOCUMENTS

| | | | |
|---|---|---|---|
| CN | 1906345 | A | 1/2007 |
| CN | 102560962 | A | 7/2012 |
| CN | 103088602 | A | 5/2013 |
| CN | 203668703 | U | 6/2014 |
| GB | 1148041 | A | 4/1969 |
| KR | 20020064542 | A | 8/2002 |
| WO | 9829595 | A3 | 10/1998 |
| WO | 2009027407 | A1 | 3/2009 |
| WO | 2016101853 | A1 | 6/2016 |

* cited by examiner

LAUNDRY WASHING MACHINE WITH ADJUSTABLE WASH CAPACITY

BACKGROUND

The present embodiments relate to wash drums for a laundry washing machine.

Typical wash drums are made for a specific wash volume. However, this practice often leads to cavities having fixed wash volumes with little flexibility to adjust the wash capacity without retooling of parts that increases the cost and time to implement changes. Thus, there is a need to adjust washer capacity while reducing cost and increasing implementation.

SUMMARY

In some embodiments of the invention, for example, a wash drum for a laundry washing machine may include a wash drum having a perforated cylindrical wall. Moreover, the cylindrical wall may have a first end and a second end, wherein the first end may define a first opening and the second end may define a second opening. In some embodiments, a trunnion may be coupled to the second end of the cylindrical wall. In some embodiments, the wash drum may include a wash chamber that is adapted to have a range of wash capacities. In various embodiments, the range of wash capacities may include at least a first wash capacity and a second wash capacity. Moreover, the second wash capacity may be smaller than the first wash capacity. In addition, in some embodiments, a rear cover insert may be disposed within the cylindrical wall away from the second end substantially closing off the second opening. In some embodiments, the rear cover insert may have an interior surface and an opposing exterior surface. Moreover, the interior surface may face towards the first end to at least partially define the second wash capacity.

In some embodiments, the rear cover insert may include a body. Moreover, the body may include a central disc member with a depending cylindrical skirt. In various embodiments, the depending cylindrical skirt of the rear cover insert may engage the cylindrical wall. Moreover, in some embodiments, the central disc member of the rear cover insert may include one or more impellers projecting into the wash chamber. In some embodiments, a rear cover may be positioned between the trunnion and the rear cover insert. In some embodiments, the second end of the cylindrical wall may be curled. In various embodiments, an outer periphery of the rear cover insert may conform to an inner surface of the cylindrical wall. In addition, in various embodiments, the exterior surface of the rear cover insert may define a volume of the wash drum not part of the second wash capacity.

In some embodiments, a laundry washing machine may include a housing, a wash tub, a wash drum, a trunnion, a rear cover insert, and/or a rear cover. In some embodiments, the wash tub may be positioned within the housing. In various embodiments, the wash drum may be positioned within the wash tub and may have a perforated cylindrical wall. Moreover, in some embodiments, the cylindrical wall may have a first end and a second end. In some embodiments, the first end may define a first opening and the second end may define a second opening. In various embodiments, the trunnion may be attached to the wash drum at the second end of the cylindrical wall. In addition, in some embodiments, the wash drum may include a wash chamber that is adapted to have a range of wash capacities. In some embodiments, the range of wash capacities may include at least a first wash capacity and a second wash capacity. Moreover, the second wash capacity may be smaller than the first wash capacity. In addition, in various embodiments, the rear cover insert may be disposed within the cylindrical wall away from the second end substantially closing off the second opening. Further, in some embodiments, the rear cover insert may have an interior surface and an opposing exterior surface. In some embodiments, the interior surface may face towards the first end to at least partially define the second wash capacity. In various embodiments, the rear cover may be positioned between the trunnion and the rear cover insert.

In addition, in various embodiments, the rear cover insert may include a body. In some embodiments, the body may include a central disc member with a depending cylindrical skirt. Moreover in some embodiments, the depending cylindrical skirt of the rear cover insert may engage the cylindrical wall. In addition, in some embodiments, the central disc member of the rear cover insert may include one or more impellers projecting into the wash chamber. In various embodiments, an outer periphery of the rear cover insert may conform to an inner surface of the cylindrical wall. In some embodiments, the exterior surface of the rear cover insert may define a volume of the wash drum not part of the second wash capacity. Moreover, in various embodiments, the cylindrical wall may further have a step adjacent the rear cover insert. In some embodiments, the second end of the cylindrical wall may be curled. In addition, in some embodiments, the wash drum may be positioned within the housing in a substantially horizontal orientation.

Other embodiments may include the method of adjusting a wash capacity of a wash drum for a laundry washing machine. The method may include providing a wash drum having a perforated cylindrical wall. Further, the cylindrical wall may have a first end and a second end. Moreover, the first end may define a first opening and the second end may define a second opening. In addition in some embodiments, the cylindrical wall may have at least one attachment spaced away from the second end of the cylindrical wall towards the first end. The method may include providing a first rear cover insert. In addition, in various embodiments, the method may include determining one or more wash capacities by attaching the first rear cover insert to the cylindrical wall at the attachment.

In addition, in some embodiments, the method may include attaching a rear cover to the second end of the cylindrical wall. In some embodiments, the method may include installing the wash drum into a laundry washing machine. Further, in some embodiments, the method may include providing a second rear cover insert that may include one or more impellers and the first rear cover insert may have one or more impellers different from the one or more impellers of the second rear cover insert. In some embodiments, the method may include providing a second rear cover insert, and the first rear cover insert provides a first wash capacity and the second rear cover insert provides a second wash capacity, and the first wash capacity is different from the second wash capacity. Further, in some embodiments, the method may include replacing the first rear cover insert with a second rear cover insert, and the second rear cover insert may be different from the first rear cover insert. In addition, in various embodiments, the method may include increasing the one or more wash capacities by uninstalling the first rear cover insert. In some embodiments, the step of attaching the first rear cover insert may include at least one of screwing, snapping, or spinning the first rear cover insert into engagement with cylindrical wall of the wash drum. In various embodiments, the method may include attaching a trunnion to the second end of the wash drum.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a front-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, they may be used in commercial applications in some embodiments. Moreover, they may be used in connection with other laundry washing machine configurations. For example, a top-load laundry washing machine that includes a top-mounted door in a cabinet or housing that provides access to a vertically-oriented wash tub housed within the cabinet or housing may be used. Implementation of the herein-described techniques within a top-load laundry washing machine would be well within the abilities of one of ordinary skill in the art having the benefit of the instant disclosure, so the invention is not limited to the front-load implementation discussed further herein.

Figure 1:
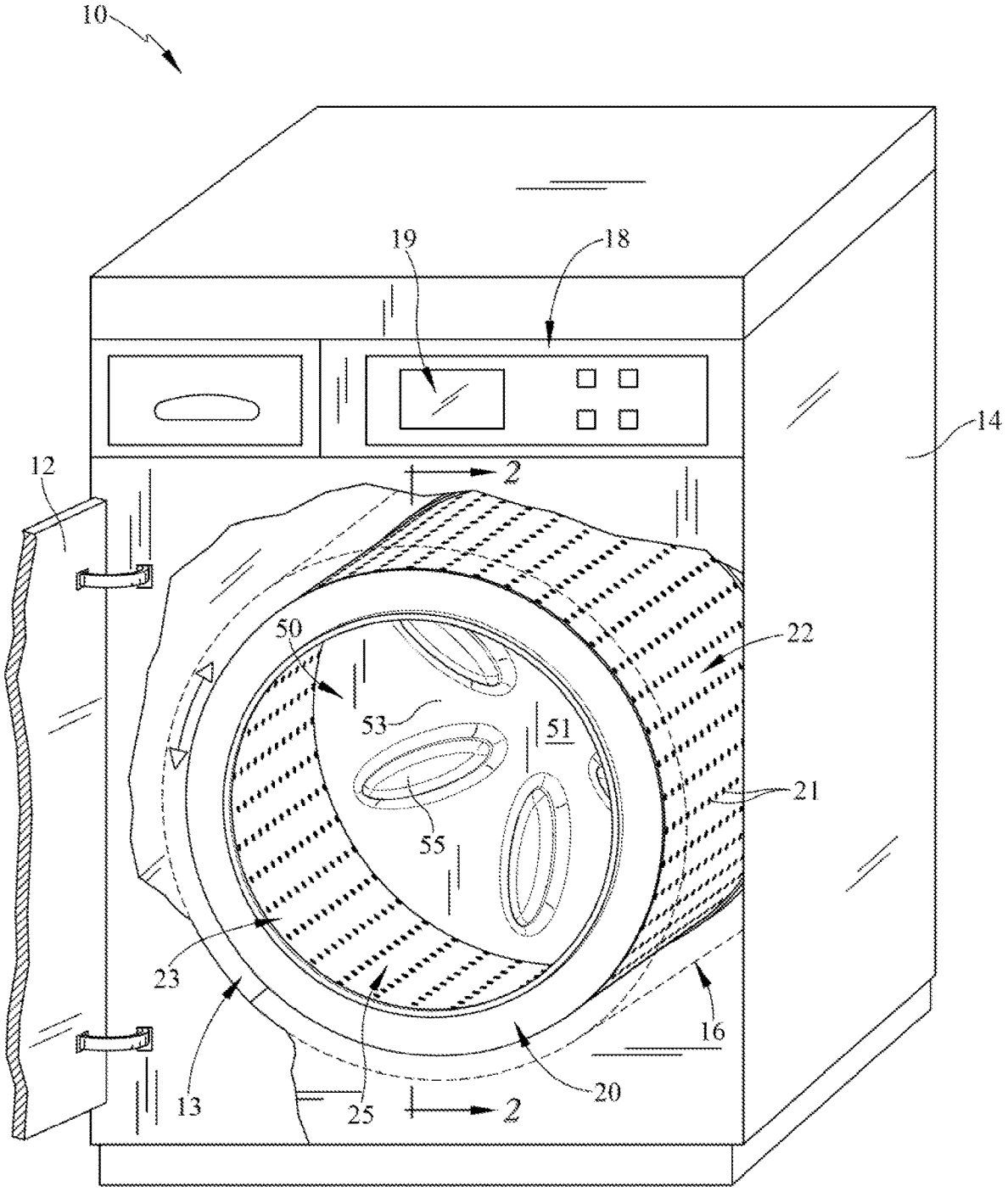
FIG. 1 is a perspective view of one embodiment of a wash drum with portions of an embodiment of the laundry washing machine broken away.

Turning now to the drawings, wherein like numbers denote like parts throughout the several views, FIG. 1 illustrates an example laundry washing machine 10 in which the various technologies and techniques described herein may be implemented. Laundry washing machine 10 is a front-load washing machine, and as such includes a front-mounted door 12 in a cabinet or housing 14 defining an opening 13 that provides access to a horizontally-oriented wash drum or basket 20 and wash tub 16 housed within the cabinet or housing 14. Door 12 is generally hinged along a side or front edge and is pivotable between the open position illustrated in FIG. 1 and a closed position (not shown). When door 12 is in the opened position, clothes and other washable items may be inserted into and removed from the wash chamber 25 within the wash drum 20 through the opening 13 in the front of cabinet or housing 14. The wash tub 16 houses the wash drum 20 that includes a plurality of perforations 21. In some embodiments, a drive mechanism rotates the wash drum 20 via a trunnion 30 relative to the wash tub 16, wherein a liquid may be circulated within the wash tub 16, and thereby the wash drum 20, with an amount of liquid to at least partially submerge the fabric load. Rotation of the wash drum 20 imparts mechanical energy to the liquid and to the fabric articles to move the articles within the wash chamber. The wash chamber 25 defines a wash capacity or volume.

Control over washing machine 10 by a user is generally managed through a control panel 18. The control panel 18 may be disposed on one or more surfaces of the machine 10 and implementing a user interface 19. It will be appreciated that in different washing machine designs, control panel 18 may include various types of input and/or output devices, including various knobs, buttons, lights, switches, textual and/or graphical displays, touch screens, etc. through which a user may configure one or more settings or cycles.

As is shown in the Figures, the wash drum 20, or more specifically the cylindrical wall 22, may be adjustable between one or more wash capacities or a range of wash capacities using and/or not using one or more rear cover inserts. In some embodiments, the wash drum 20 includes a substantially cylindrical wall 22 that may be perforated. The perforated cylindrical wall 22 may have a plurality of perforations 21 extending between the interior surface **22*a* and the exterior surface 22*b*. The cylindrical wall 22 may include a first end 20*a* and an opposing second end 20*b*. The first end 20*a* of the cylindrical wall 22 may define a first opening 23 for inserting and removal of the fabric articles and faces generally towards the front of the laundry washing machine 10 in use. In some embodiments, a front cover 40 having a through opening may be lock seamed to the first end 20*a* defining first opening 23. The second end 20*b* of the cylindrical wall 22 may define a second opening 24. The second end 20*b* may engage the trunnion 30 mechanically coupled to one or more drive mechanisms (not shown). Although not shown, the cylindrical wall may include one or more agitators extending radially inward from the interior surface 22*a* into the wash chamber 25**.

The adaptability of the second end of the wash drum to be substantially closed at one or more various positions allows the wash drum embodiments to achieve a variety of wash capacities. For example, a rear cover insert 50, rear cover 60, or both may be used along the longitudinal axis of the wash drum's length L to achieve a variety of wash capacities within cylindrical wall embodiments. If used in some embodiments, a rear cover insert 50 may be coupled at an attachment position 26 with the cylindrical wall 22 of the wash drum 20 such that an interior surface 51 provides a desired wash capacity (i.e. WC1). Moreover in some embodiments, a rear cover 60, if used, may be coupled at another attachment position 28 with the cylindrical wall 22 of the wash drum 20 such that an interior surface 61 provides a desired wash capacity (i.e. WC3). Further in some embodiments, the rear cover 60 and rear cover insert 50 may be used together such that the interior surface 51 of the rear cover insert 50 provides a wash capacity (i.e. WC1) for an application of the laundry washing machine.

Figure 2:
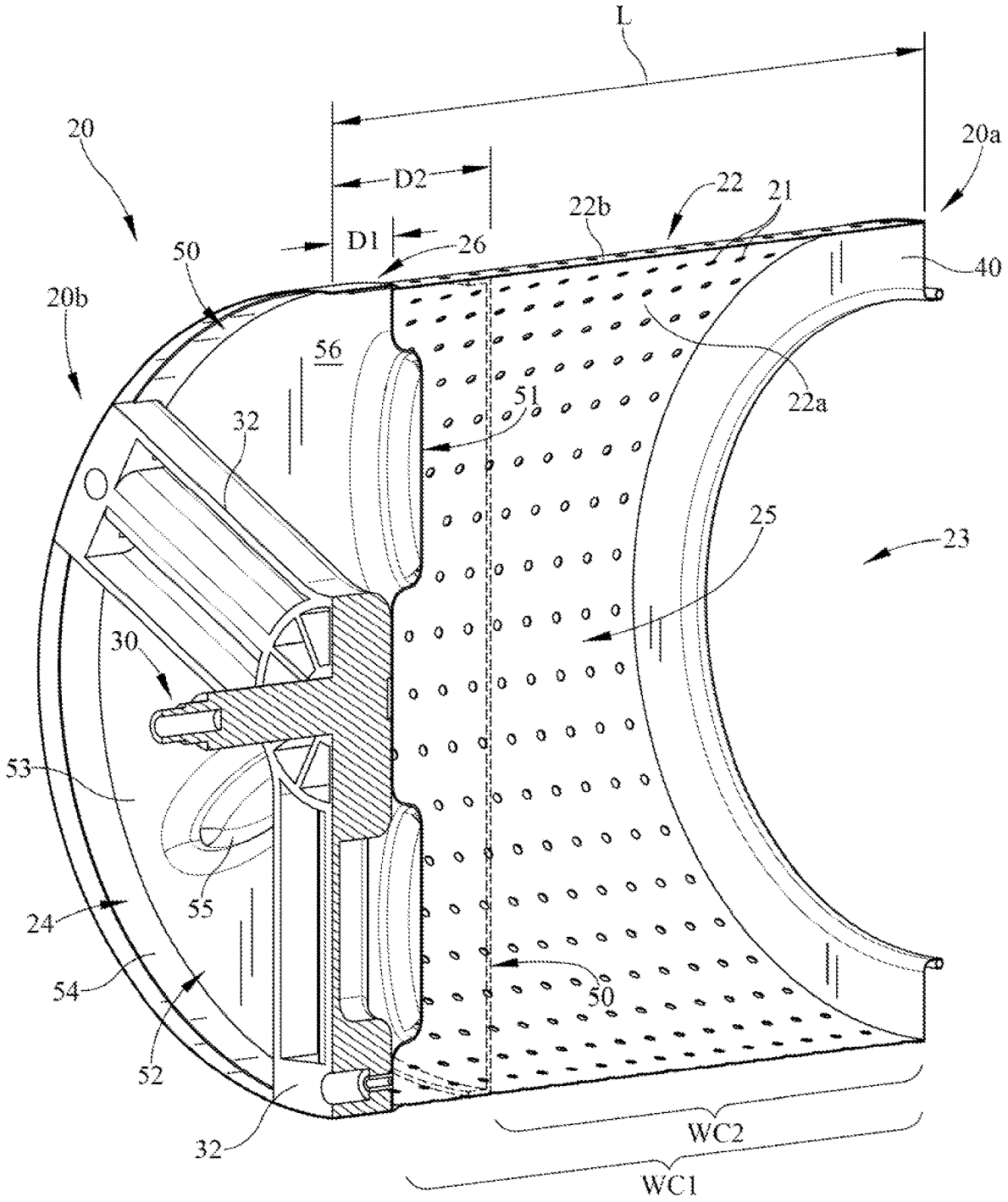
FIG. 2 is a side section view of the wash drum of FIG. 1 taken along line 2-2 illustrating a rear cover insert defining the wash capacity.
Figure 3:
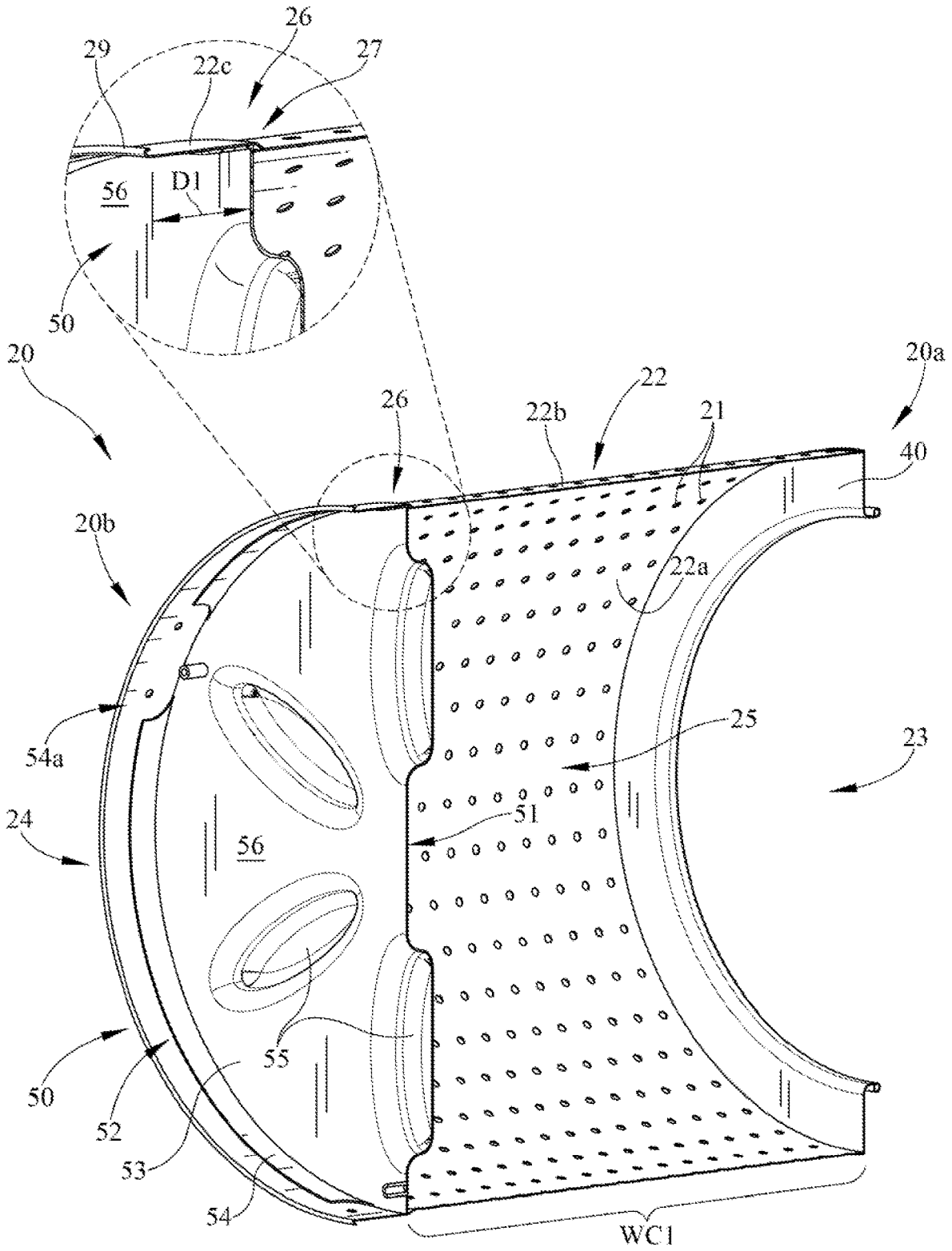
FIG. 3 a side section view of the wash drum of FIG. 2 with the trunnion removed.
Figure 4:
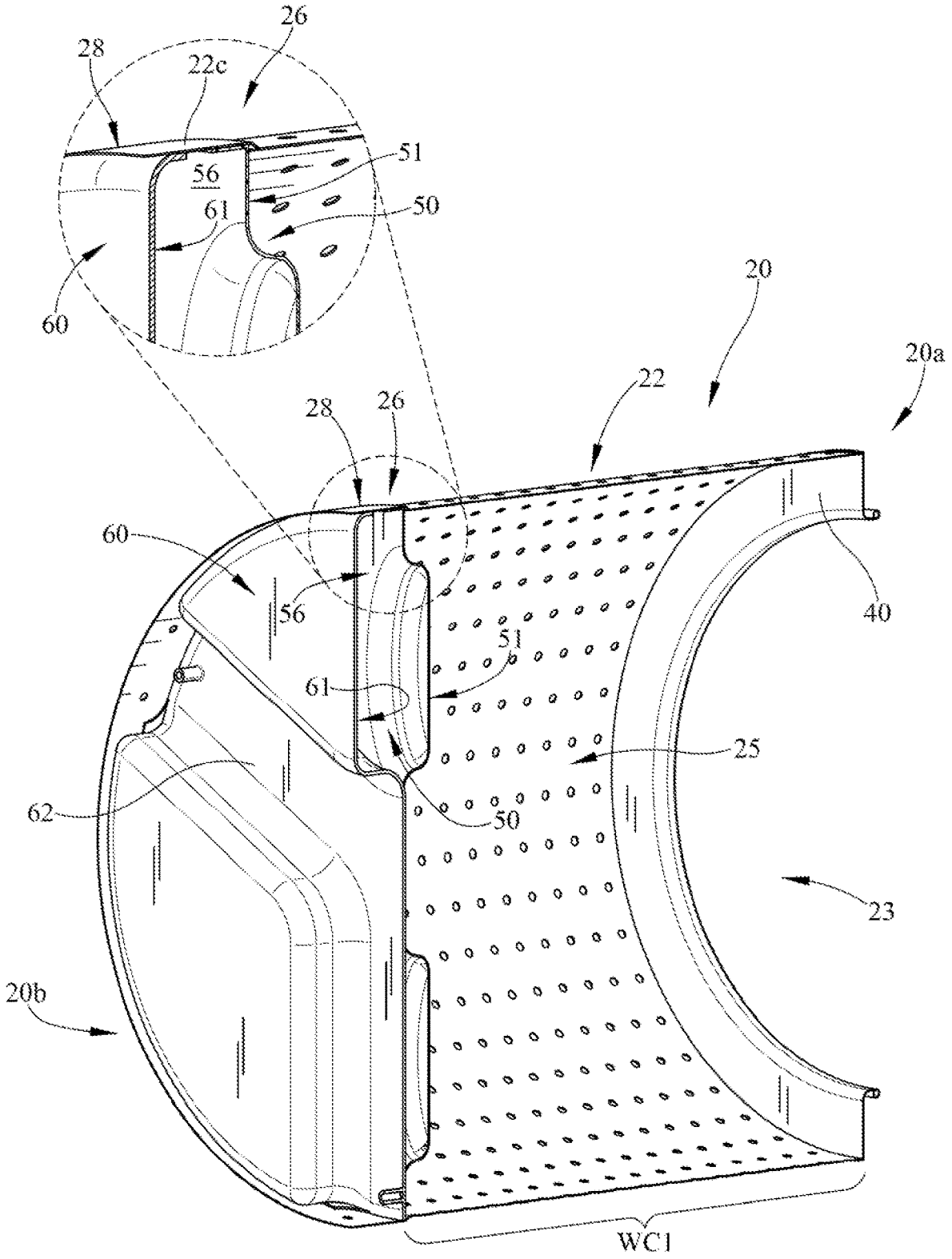
FIG. 4 is a side section view of the wash drum of FIG. 1 taken along line 2-2 with the trunnion removed, illustrating a rear cover and a rear cover insert defining the wash capacity.

As shown in FIGS. 2-4, one embodiment of the rear cover insert 50 may be coupled to the cylindrical wall 22 at one or more attachment positions to provide for a variety of wash capacities. The rear cover insert 50 may be, but is not limited to, spun, screwed, or snapped into one or more positions or engagement with the cylindrical wall 22. One attachment position 26 may be spaced away from the second end 20*b* of the cylindrical wall towards the first end 20*a*, or more specifically in some embodiments spaced from the trunnion 30 attached to the second end 20*b* of the cylindrical wall 22. In one embodiment shown in FIG. 3, the cylindrical wall 22 may include one or more steps 27 that includes wall portions 22*c* with a larger diameter than a remaining portion of the cylindrical wall towards the first end 20*a*. This step 27 from a larger diameter to a smaller diameter within the cylindrical wall 22 may be the attachment position 26 to engage one or more embodiments of the rear cover insert 50. It should be understood that the rear cover insert 50 may be positioned at a variety of positions along the length L of the cylindrical wall 22 and still be spaced from the second end 20*b* to obtain a variety of wash capacities for a desired laundry machine application. For example, the rear cover insert 50 at the attachment position 26 may be engaged to or received by the cylindrical wall 22 at a first distance D1 spaced from the second end 20*b* to create a first wash capacity WC1 with the interior surface 51. As a result, there is a volume or a portion of the cylindrical drum, between the exterior surface 56 of the rear cover insert 50 and the second end 20*b*, that is not utilized for a particular application or desired wash capacity. Further as shown in FIG. 2, in some embodiments a rear cover insert 50 (shown in broken lines) may be attached to the cylindrical wall 22 at a second distance D2 from the second end 20*b*, larger than first distance D1, to create a second wash capacity WC2 smaller than the first wash capacity WC1.

In some embodiments, one or more different rear cover inserts 50 may attach to the attachment position 26 (i.e. at distance D1) of the cylindrical drum wall 22 to achieve varying wash capacities depending on the application. For example, a first rear cover insert may be coupled to the attachment position 26 and result in a first wash capacity WC1. Further, a second rear cover insert, different from the first rear cover insert, may be coupled to the attachment position 26 at D1 and result in a wash capacity different (i.e. smaller or larger) from the first wash capacity WC1. For example, rear cover inserts may have different shaped or sized interior surfaces 51 that correspond to a different wash capacity.

Figure 5:
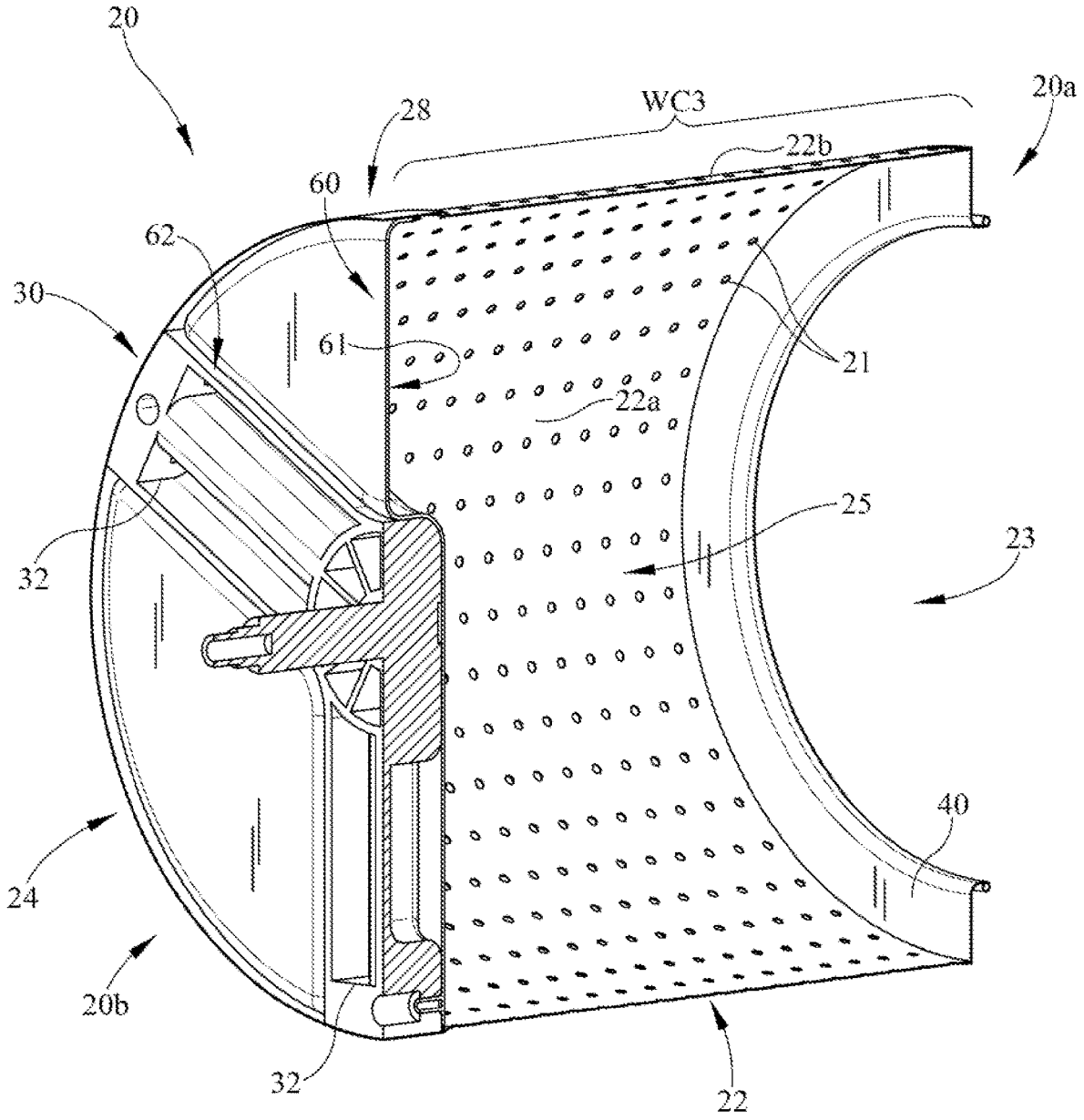
FIG. 5 is a side section view of the wash drum of FIG. 1 taken along line 2-2 with the trunnion removed, illustrating a rear cover defining the wash capacity.

As shown in FIGS. 2-5, the rear cover insert 50 may be used alone or in combination with the rear cover 60 in some embodiments. The cylindrical wall 22 of the wash drum 20 as illustrated in FIGS. 4 and 5 includes another attachment position 28 adapted to receive or engage the rear cover 60. If used, the rear cover 60 may be coupled at the attachment position 28 to the cylindrical wall 22 adjacent the second end 20*b*, second opening 24, and/or trunnion 30. More specifically in the embodiment shown, the rear cover 60 may be lock seamed to the free end of the cylindrical wall 22 adjacent the second opening 24. As shown in FIG. 4, in some embodiments where the rear cover 60 is used with a rear cover insert 50, the wash capacity WC1 is dependent on the interior surface 51 of the rear cover insert 50 not the rear cover 60. As shown in the embodiment, the rear cover 60 may be positioned between the trunnion 30 and the rear cover insert 50. The rear cover 60 or portions thereof are spaced away from the rear cover insert 50 or portions thereof. If used, in some embodiments embossments 62 of the rear cover 60 may receive the trunnion arms 32. Further, the material of the rear cover 60 may be, but is not limited to, 400 series stainless steel.

In some embodiments as shown in FIG. 5, the rear cover 60 may be used without the rear cover insert 50 for an application of the laundry washing machine 10. This embodiment of the wash drum 20 may be desired to obtain the maximum or larger wash capacity (i.e. third wash capacity WC3) of the cylindrical wall 22 or wash drum 20 in an application. The third wash capacity WC3 defined by the interior surface 61 of the rear cover 60 is larger than the first wash capacity WC1 shown in FIG. 2. It should be understood that this third wash capacity WC3 could otherwise be reduced if a rear cover insert were used in combination for one or more applications. Although an embodiment of the rear cover 60 is shown in the figures, it should be understood that the rear cover may be a variety of shapes, sizes, quantities, and constructions.

A variety of rear cover inserts may be used or selected depending on the desired wash capacity for one or more applications of the laundry washing machine 10. In the one embodiment shown in FIGS. 1-4, the rear cover insert 50 may include a body 52 having an outer periphery. The outer periphery may also be described as conforming to a variety of shapes and sizes of the cylindrical wall 22 (i.e interior surface and/or one or more inner diameters of the cylindrical wall) of the wash drum 20 at the attachment position. The outer periphery in one embodiment is substantially circular. The body 52 may include a central disc member 53 with a depending skirt 54. When installed the interior surface 51 may face towards and at least partially define the wash chamber 25 and the exterior face 56 may face towards the second end 20*b*. It should be understood that the interior surface 51 may be a variety of shapes and sizes to at least partially define the wash capacity of the wash drum 20. In the one embodiment shown, the central disc member 52 defines the interior surface 51 extending inwardly from the outer periphery of the body 52 adjacent the skirt 54 and/or cylindrical wall 22. In one embodiment, the depending skirt 54 may extend towards the second end 20*b* of the cylindrical wall 22. Further, the central disc member 53 may be spaced at a distance D1 from the second end 20*b*. Although the depending skirt 54 is shown as extending partially about the circumference of the disc member 53, the skirt 54 may be substantially continuous around the outer periphery. The space 54*a* defined between one or more portions of the skirt 54 may receive or straddle the trunnion arms 32. In various embodiments, the rear cover insert 50 or interior surface 51 may include one or more protrusions or impellers 55. As shown in the embodiment, the impellers 55 project from the disc member 53 and into the wash chamber 25 or wash drum. This may increase mechanical wash action of the fabric article. It should be understood that the impellers 55 may project towards the wash chamber 25, away from the wash chamber, or both. In some embodiments, the rear cover insert 50 may be, but is not limited to, a variety of one or more plastic materials. In some embodiments, the rear cover insert may be plated, such as, but not limited to, nickelplated. It may be desirable to use or select the impeller design of one or more different rear cover inserts depending on the application and/or wash capacity desired for an application. Although an embodiment of the rear cover insert 50 is shown in the figures, it should be understood that the rear cover insert may be a variety of shapes, sizes, quantities, and constructions. Moreover, although the rear cover insert 50 is coupled to the inner diameter of the cylindrical wall 22 in the embodiment shown, it should be understood that the rear cover insert may be coupled to or engage the rear cover 60 if used, trunnion 30, cylindrical wall 22, or combinations thereof and still provide the interior surface 51 to define the desired wash capacity.

In use, one or more wash drums may be manufactured that may be varied between a range of wash capacities or capable of adjusting the wash capacity. For example, a first wash drum may have a cylindrical wall with a diameter, length, dimension, or shape, etc. In various embodiments the first wash drum may have a range of wash capacities between 4.1 and 6.0 cubic feet. Depending on the wash capacity desired, one of the rear cover inserts (i.e. first rear cover insert) may be selected to be inserted within or attached to the cylindrical wall and coupled at the attachment position 26 at a distance (i.e. D1 or towards the first end) to define a first wash capacity (i.e. 5.0 cubic feet). Moreover the rear cover insert 50 may be used with a rear cover 60, if used in some embodiments, and still provide a first wash capacity (i.e. 5.0 cubic feet). In another embodiment, a second rear cover insert 50 (i.e. with a different interior surface configuration) could be inserted into the first wash drum 20 and coupled at the attachment position 26 to define a different wash capacity (i.e. 4.1 cubic feet). In various embodiments, the first rear cover insert could be inserted and coupled at a different or other attachment position (i.e. D2, at a distance greater than D1) to define a different or second wash capacity WC2 (i.e. 4.5 cubic feet). In some embodiments, the first or second rear cover inserts may be installed or attached before or after a rear cover, if used, and/or trunnion is installed. Moreover if used, the rear cover 60 may be attached to the different attachment position 28 adjacent the second end 20*b*, without a rear cover insert, to define another or different third wash capacity WC3 (i.e. 6.0 cubic feet). It should be understood that another or second wash drum may be manufactured to have a different range of wash capacities, such as 5.0 to 6.0 cubic feet (i.e. such as a cylindrical wall having a different diameter, length, shape, or dimension, etc than the first wash drum). Moreover, in some embodiments, the one or more rear cover inserts may have similar or dissimilar impellers, if used, to create wash actions that may be selected for an application of the laundry washing machine. It should be understood that providing a variety of one or more cylindrical walls, wash drums, rear covers, and/or one or more rear cover inserts may define, but is not limited to, one or more ranges of wash capacities and/or mechanical wash actions. It should be understood that the rear cover inserts may be installed and/or removed throughout the life cycle of the laundry washing machine, such as but not limited to during manufacture and/or by the end user to adjust different characteristics of the washing (i.e. wash capacity, mechanical wash action, etc.). In some embodiments, the user may increase the wash capacity by removing the insert or reduce/change the wash capacity by installing a rear cover insert.

In some embodiments, the second end 20*b* of the cylindrical wall 22 may be curled. This embodiment of an outward curl 29 at the free end of the cylindrical 22 wall may be more clearly shown in the enlarged portion of FIG. 3. In some embodiments, this may strengthen the wash drum cylindrical wall 22 such as when the rear cover insert 50 is used without the rear cover 60.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure. In some embodiments, All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of"

"Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A method of adjusting a wash capacity of a wash drum for a laundry washing machine, comprising the steps of:

providing a wash drum having a perforated cylindrical wall, wherein the cylindrical wall has a first end and a second end, wherein the first end defines a first opening and the second end defines a second opening, and the cylindrical wall having at least one attachment position spaced away from the second end of the cylindrical wall towards the first end;

providing a first rear cover insert;

providing a second rear cover insert, wherein the first rear cover insert provides a first wash capacity and the second rear cover insert provides a second wash capacity, and wherein the first wash capacity is different from the second wash capacity; and determining one or more wash capacities by attaching the first rear cover insert to the cylindrical wall at the at least one attachment position.

2. The method of claim 1 further comprising the step of attaching a rear cover to the second end of the cylindrical wall.

3. The method of claim 1 further comprising the step of installing the wash drum into a laundry washing machine.

4. The method of claim 1 further comprising the step of providing the second rear cover insert having one or more impellers, wherein the first rear cover insert has one or more impellers different from the one or more impellers of the second rear cover insert.

5. The method of claim 1 further comprising the step of replacing the first rear cover insert with the second rear cover insert, wherein the second rear cover insert is different from the first rear cover insert.

6. The method of claim 1 further comprising the step of increasing the one or more wash capacities by uninstalling the first rear cover insert.

7. The method of claim 1 wherein the step of attaching the first rear cover insert includes at least one of screwing, snapping, and/or spinning the first rear cover insert into engagement with the cylindrical wall of the wash drum.

8. The method of claim 1 further comprising the step of attaching a trunnion to the second end of the wash drum.

9. A method of adjusting a wash capacity of a wash drum for a laundry washing machine, comprising the steps of:

providing a wash drum having a perforated cylindrical wall, wherein the cylindrical wall has a first end and a second end, wherein the first end defines a first opening and the second end defines a second opening, and the cylindrical wall having at least one attachment position spaced away from the second end of the cylindrical wall towards the first end;

providing a first rear cover insert;

providing a second rear cover insert having one or more impellers, wherein the first rear cover insert has one or more impellers different from the one or more impellers of the second rear cover insert; and determining one or more wash capacities by attaching the first rear cover insert to the cylindrical wall at the at least one attachment position.

10. The method of claim 9 further comprising the step of attaching a rear cover to the second end of the cylindrical wall.

11. The method of claim 9 further comprising the step of installing the wash drum into a laundry washing machine.

12. The method of claim 9 further comprising the step of increasing the one or more wash capacities by uninstalling the first rear cover insert.

13. The method of claim 9 wherein the step of attaching the first rear cover insert includes at least one of screwing, snapping, and/or spinning the first rear cover insert into engagement with the cylindrical wall of the wash drum.

14. The method of claim 9 further comprising the step of attaching a trunnion to the second end of the wash drum.

15. A method of adjusting a wash capacity of a wash drum for a laundry washing machine, comprising the steps of:

providing a wash drum having a perforated cylindrical wall, wherein the cylindrical wall has a first end and a second end, wherein the first end defines a first opening and the second end defines a second opening, and the cylindrical wall having at least one attachment position spaced away from the second end of the cylindrical wall towards the first end;

providing a first rear cover insert;

replacing the first rear cover insert with a second rear cover insert, wherein the second rear cover insert is different from the first rear cover insert; and determining one or more wash capacities by attaching the first rear cover insert to the cylindrical wall at the at least one attachment position.

16. The method of claim 15 further comprising the step of attaching a rear cover to the second end of the cylindrical wall.

17. The method of claim 15 further comprising the step of installing the wash drum into a laundry washing machine.

18. The method of claim 15 further comprising the step of increasing the one or more wash capacities by uninstalling the first rear cover insert.

19. The method of claim 15 wherein the step of attaching the first rear cover insert includes at least one of screwing, snapping, and/or spinning the first rear cover insert into engagement with the cylindrical wall of the wash drum.

20. The method of claim 15 further comprising the step of attaching a trunnion to the second end of the wash drum.

* * * * *